US007958615B1

(12) United States Patent
Conn

(10) Patent No.: US 7,958,615 B1
(45) Date of Patent: Jun. 14, 2011

(54) NOZZLE MOUNTING ASSEMBLY

(75) Inventor: Dominic Conn, Tempe, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 699 days.

(21) Appl. No.: 12/045,951

(22) Filed: Mar. 11, 2008

(51) Int. Cl.
*B23P 25/00* (2006.01)

(52) U.S. Cl. ..... 29/458

(58) Field of Classification Search ..... 29/458, 29/428, 418, 422, 423, 425, 527.1, 527.2, 29/527.3; 239/600, 589
See application file for complete search history.

(56) References Cited

U.S. PATENT DOCUMENTS 6,301,723 B1 10/2001 Goettl
6,367,098 B1 4/2002 Barnes
7,481,377 B2 * 1/2009 Goettl et al. ..... 239/11
7,708,212 B1 * 5/2010 Conn ..... 239/600
7,819,338 B1 * 10/2010 Goettl ..... 239/205

* cited by examiner

*Primary Examiner* — John C Hong
(74) *Attorney, Agent, or Firm* — Booth Udall, PLC

(57) ABSTRACT

A nozzle mounting assembly for an in-ground swimming pool cleaning system may comprise a plurality of mounting rings that are formed within the shell of a prefabricated swimming pool. The plurality of mounting rings may couple at a first end with a corresponding plurality of trim rings. The plurality of trim rings forms a flanged ring around each of the openings in the pool surface for cleaning nozzle mechanisms. The plurality of mounting rings may further couple with a corresponding plurality of nozzle retainer bodies, where the nozzle retainer bodies provide an interface for standard cleaning system fittings. Nozzle mounting assemblies may be adapted to a variety of pool types and surfaces, and may be sized for the floor surface, the steps or the walls of a swimming pool.

11 Claims, 15 Drawing Sheets

NOZZLE MOUNTING ASSEMBLY

BACKGROUND

A. Field of the Invention

The present disclosure generally relates to nozzle mounting assemblies for swimming pools, and more specifically to mounting assemblies for attaching in-floor swimming pool cleaning systems.

B. Background Art

In-floor cleaning systems are common in the swimming pool industry. These systems typically consist of pop-up and retractable cleaning nozzles installed in the floor and stairs of a swimming pool. The nozzles are connected to a water supply piping system that is fed from a pool pump. When the cleaning system is not activated, the cleaning nozzles are retracted into a retaining collar and are substantially flush with the surface of the swimming pool. When the cleaning system is then activated, pressurized water from the pump causes the nozzles to pop up from the flush position and to eject a stream of water across the floor surface of the swimming pool.

When a series of nozzles are embedded in the floor of a swimming pool, water flow through nozzles can be used to stir up debris and contaminants on the pool floor. Often, nozzles used in swimming pool applications contain components that allow their position to be automatically adjusted after each period of use to enable gradual spraying of the entire surface of pool floor.

In-floor cleaning systems are commonly used with swimming pool installations that are poured at an excavation site. These pool surfaces may be formed of concrete, plaster, various composites or other materials as known in the applicable art. In-floor cleaning systems may also be used with fiberglass pools. Fiberglass pools generally include a one-piece shell, made with at least fiberglass and resins, and finished with a gel coating.

Fiberglass pools are generally manufactured in a factory setting. After the fiberglass pool shell is created, several pool shells are stacked onto a truck trailer at the manufacturing site and transported to a warehouse, retail outlet or installation location. Standard designs for in-floor cleaning systems require that certain plumbing components be formed into the fiberglass shells at the factory that can be coupled to in-ground plumbing at the installation site. The plumbing parts that are typically molded into the fiberglass shell include a nozzle connector and an elbow section. This is accomplished at the factory by placing the nozzle connector and elbow on the pool casting as the fiberglass pool shell is being created so that the nozzle connector and elbow become an integral part of the shell. When nozzle connectors with elbow sections are formed into the shell, they extend six or more inches from the bottom surface of the shell. When the shells are stacked, spacers are placed between the shells to protect the shells and the plumbing extensions. These plumbing extensions that include the elbow joint encased in fiberglass and resin limit the number of fiberglass shells that may be loaded onto a trailer and increase the risk of damage to the fiberglass pools due to their height.

Traditional nozzle connectors attached to an elbow joint are difficult to consistently align perpendicular to the pool surface when placed within a fiberglass pool casting. It is common, therefore, for the top surface of a nozzle connector to be slightly angled after a fiberglass shell has been formed. This alignment inconsistency can be problematic for field installers who are responsible for connecting all of the plumbing to the in-floor cleaning systems. When the pop-up nozzles are not perpendicular to the surrounding pool surface or are not maintained at a set height in relation to the interior pool surface, they are less efficient during the cleaning process and require filing or other trimming of the nozzle connector that extends from the inside surface of the pool. Alignment problems can also lead to water leaks at points where the fiberglass shell is not fully secured to a nozzle connector.

SUMMARY

In one aspect, a swimming pool nozzle mounting assembly includes a plurality of mounting rings and a swimming pool shell with an inner pool surface. The swimming pool shell is formed around the plurality of mounting rings. The plurality of mounting rings is formed of a material that is compatible with fiberglass resins. The plurality of mounting rings may include an inside wall with a substantially cylindrical inner surface defining an inner diameter, and an outside wall with a substantially cylindrical surface and including at least one protrusion. The plurality of mounting rings each also includes open first and second ends.

Particular implementations of a nozzle mounting assembly may also include a plurality of nozzle retainer bodies where each nozzle retainer body corresponds to one of the plurality of mounting rings. Each nozzle retainer body may include a substantially cylindrical outside surface with an outside diameter that is smaller than the inner diameter of the corresponding mounting ring. Each nozzle retainer body may also couple to the second end of the corresponding mounting ring and include a plurality of lugs on an inner surface.

Particular implementations of a nozzle mounting assembly may also include a plurality of trim rings wherein each trim ring corresponds to one of the plurality of mounting rings. The trim rings include a lower fitting that slidably couples with the first end of a corresponding mounting ring, and an upper flange that extends outward from the lower fitting and is substantially parallel to the inner pool surface.

In some implementations, the lower fitting of each of the plurality of trim rings is in contact with the nozzle retainer body that corresponds to the mounting ring upon which a particular trim ring is coupled. The upper flange of each of the plurality of trim rings extends across a transition between the inner pool surface and the corresponding mounting ring, and each of the upper flanges is affixed to the inner pool surface with a silicon sealant.

Particular implementations of a nozzle mounting assembly may further include a first plurality of removable construction caps that slidably couple with the first end of one of the plurality of mounting rings. Implementations may still further include a second plurality of removable construction caps that slidably couple with the second end of one of the plurality of mounting rings.

Particular implementations may include the plurality of mounting rings where the at least one protrusion comprises a substantially continuous annular protrusion. Alternately, particular implementations may include the plurality of mounting rings where the at least one protrusion comprises a plurality of protrusions extending outward from the outside wall.

In another aspect, a particular implementation of a nozzle mounting assembly includes a nozzle retainer body with a first body member, a second body member, a recessed channel, and a plurality of lugs. The first body member includes a substantially cylindrical outside surface, a first end with an outside diameter smaller than an inner diameter of a corresponding mounting ring, and a second end. The second body member includes a substantially cylindrical outside surface with an outside diameter smaller than the outside diameter of the first body member. The second body member also couples with and extends from the first body member. The recessed channel is positioned between a first end of the second body member and the second end of the first body member. The plurality of lugs is positioned on an inner surface of the second body member.

Particular implementations may also include a plurality of nozzle retainer bodies wherein the plurality of nozzle retainer bodies is coupled with a plurality of swimming pool cleaning nozzles.

In another aspect, a particular implementation of a nozzle mounting assembly includes a method of installing a nozzle mounting assembly. The method may include one or more of the following steps: Positioning a plurality of mounting rings within a swimming pool casting; forming a swimming pool shell; removing the swimming pool shell from the swimming pool casting and relocating the swimming pool shell to an installation site; aligning the plurality of mounting rings with a plurality of plumbing connections; installing a plurality of nozzle retainer bodies; and installing a plurality of cleaning head mechanisms.

In particular implementations, the method of installing a nozzle mounting assembly may further include inserting a plurality of first removable construction caps into a first end of one of the plurality of mounting rings prior to forming the swimming pool shell. If the method includes the use of the plurality of first removable construction caps, then the method will also include the step of removing the plurality of first removable construction caps from the plurality of mounting rings after forming the swimming pool shell.

Particular implementations may also include the step of inserting a plurality of second removable construction caps into a second end of one of the plurality of mounting rings prior to forming the swimming pool shell. If the method includes the use of the plurality of second removable construction caps, then the method will also include the step of removing the plurality of second removable construction caps from the plurality of mounting rings after forming the swimming pool shell.

Particular implementations may also include the use of a plurality of trim rings. When trim rings are used, the method of installing a nozzle mounting assembly will include installing a plurality of trim rings by coupling the plurality of trim rings with the first end of a plurality of mounting rings.

These and other nozzle mounting assemblies may have one or more of the following advantages depending on which particular implementation and set of components and features is used. It may be easier for the fiberglass applicators to manufacture a swimming pool shell when using the mounting rings as compared with the more traditional fittings for cleaning systems. There may be reduced preparation required to position the mounting rings within a swimming pool casting, which improves the productivity of the applicators. The mounting rings may be formed of a material that is resistant to the heat used to apply and cure the fiberglass resins than the traditional PVC fittings. Improved heat resistance of the ring materials yields a stronger bond with the surrounding fiberglass. A stronger bond may also result in a more leak proof connection than with previous methods and materials. Other materials may have a higher heat deflection point than PVC to better resist warping caused by high temperatures during application and curing of fiberglass resins.

Another advantage of using mounting rings derives from the low profile of the rings compared with conventional elbow fittings. Traditional implementations of mounting systems produce fittings that extend several inches below the surface of the swimming pool shells. These traditional implementations are difficult to stack, which limits the number of shells that can be loaded onto a truck trailer. The lower profile of the mounting rings allows swimming pool shells to be more closely nested during transport on a truck trailer. More swimming pools per truck load decreases the total transportation cost per unit.

The trim ring component of the nozzle mounting assembly helps to minimize the amount of leakage that can occur around cleaning system fittings. The upper flange of the trim rings overlays the pool surface covering the rough transition area between the fiberglass pool gel coat and the mounting ring, and allows for the addition of sealant around the interface between the trim rings and the pool surface. The trim rings further provide the advantage of having a consistent surface to mount nozzles within the assembly thereby setting the height of the nozzle in relation to the interior surface of the pool at a set distance. Traditional implementations of in-floor cleaning nozzles may be difficult to align perpendicular with a swimming pool floor. The use of trim rings may allow for the nozzles to better align with the inside surface of a prefabricated swimming pool shell.

The nozzle retainer body may provide a further advantage of a structural support joint in particular implementations that improve the connection between the nozzle mounting assembly and the adjoining plumbing. Additionally, the design of the nozzle retainer body in particular implementations may improve the displacement of forces produced by the water once a swimming pool is filled. The annular bulge shape and low profile of the mounting ring example provided in FIG. 2 allow the fiberglass strands and cloth to more naturally fold around and form against the mounting ring when pushed in place with common tools used by shell applicators to further increase the productivity without the use of specialized tools. The shape and improved ease of application improves the bond between the mounting ring and the pool shell so that it better withstands the static load of the water trying to push the fitting out of the pool shell.

The foregoing and other aspects, implementations, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended DRAWINGS, where like designations denote like elements, and.

DESCRIPTION

Nozzle mounting assembly implementations are not limited to the specific components or assembly procedures disclosed herein, and may comprise many additional components and assembly procedures known in the art consistent with the intended nozzle mounting assembly. Accordingly, for example, although particular mounting rings, trim rings, and nozzle retainer bodies are disclosed, such mounting rings, trim rings, and nozzle retainer bodies may comprise any shape, size, style, type, model, version, measurement, and/or the like as is known in the art consistent with the intended operation of a nozzle mounting assembly.

There is a variety of possible nozzle mounting assembly implementations. Several example implementations are shown and described with reference to FIGS. 1-14. In general, a nozzle mounting assembly comprises a structure for attaching in-floor swimming pool cleaning systems. Nozzle mounting assemblies generally comprise a mounting ring, a corresponding nozzle retainer body, and a prefabricated swimming pool shell. Additional elements may include removable construction caps and a trim ring. Unlike conventional nozzle mounting assemblies, the components of particular implementations of nozzle mounting assemblies disclosed herein generally comprise a material that is heat resistant to the fiberglass resin application and curing process. The components also have adequate structural integrity and strength to support the various solid and fluid forces that act upon the nozzle mounting assembly.

Conventional nozzle mountings use ABS and PVC, which is not compatible with the fiberglass resin used for swimming pools because they are soft and can melt and deform easily from the heat caused by the chemical process of applying fiberglass resins. As a result, the conventional fiberglass pool manufacturing process involves the additional steps of coating the individual elbow joints by hand with several thin protective layers of fiberglass and resin that are then allowed to cure overnight. By pre-applying several thin layers of fiberglass and resin by hand to the individual elbow joints, the heat applied in this manual process is kept low enough to not deform the fittings. This hardened layer then protects the fittings from the high heat generated during the heavy thicker layers of the complete pool building process before fiberglass is wrapped around the elbow individually.

Figure 1A:
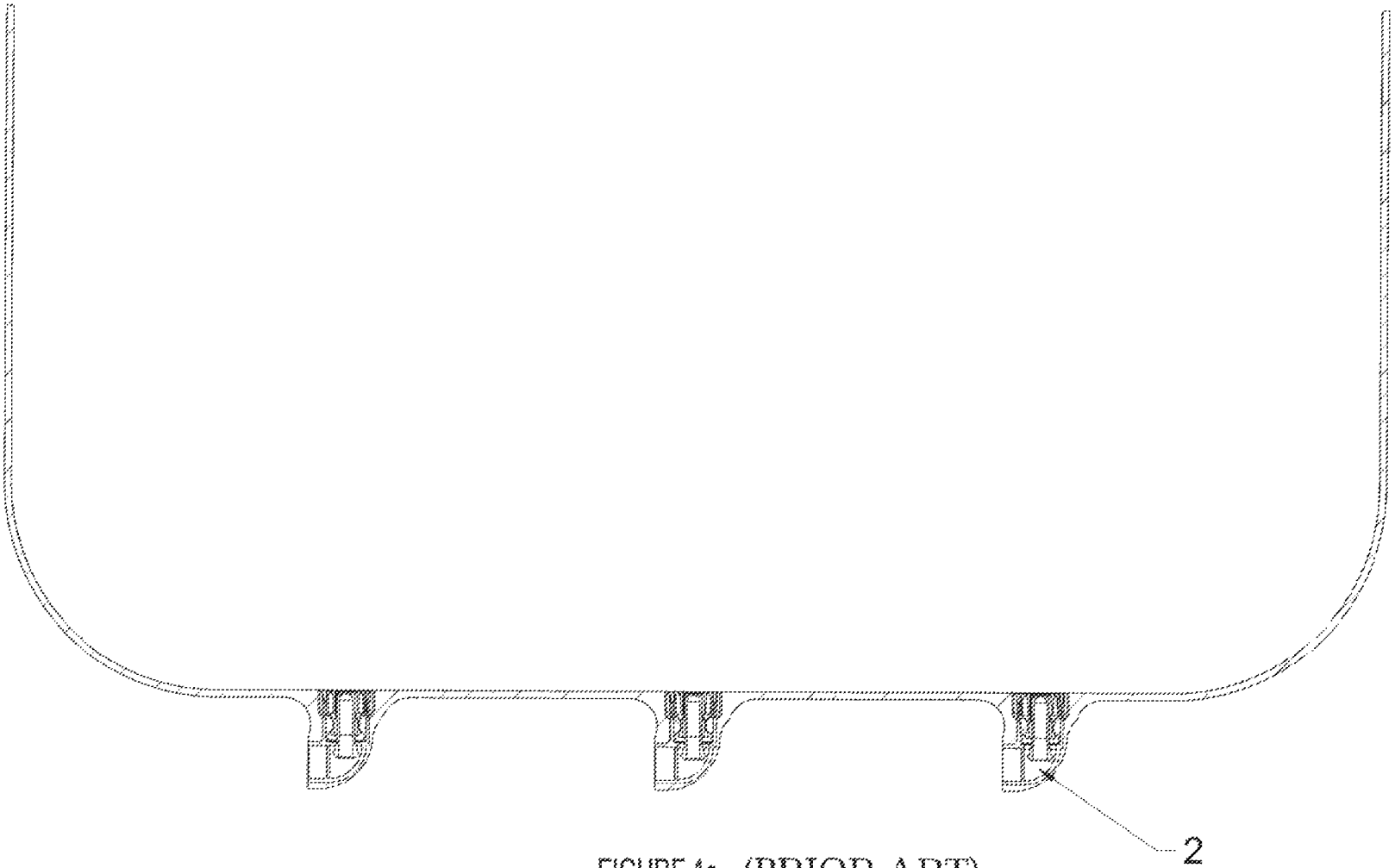
FIGURE 1a (PRIOR ART)
FIG. 1*a* is a cross section of a conventional arrangement of plumbing parts molded into a prefabricated swimming pool shell.

FIG. 1*a* illustrates a cross-section of a conventional nozzle mounting assembly in a prefabricated swimming pool shell. Existing assemblies typically require that a plurality of plumbing elbow sections 2 be formed within a prefabricated swimming pool shell. The elbow sections 2 limit the number of swimming pool shells that can be transported on a single tractor trailer.

Figure 1B:
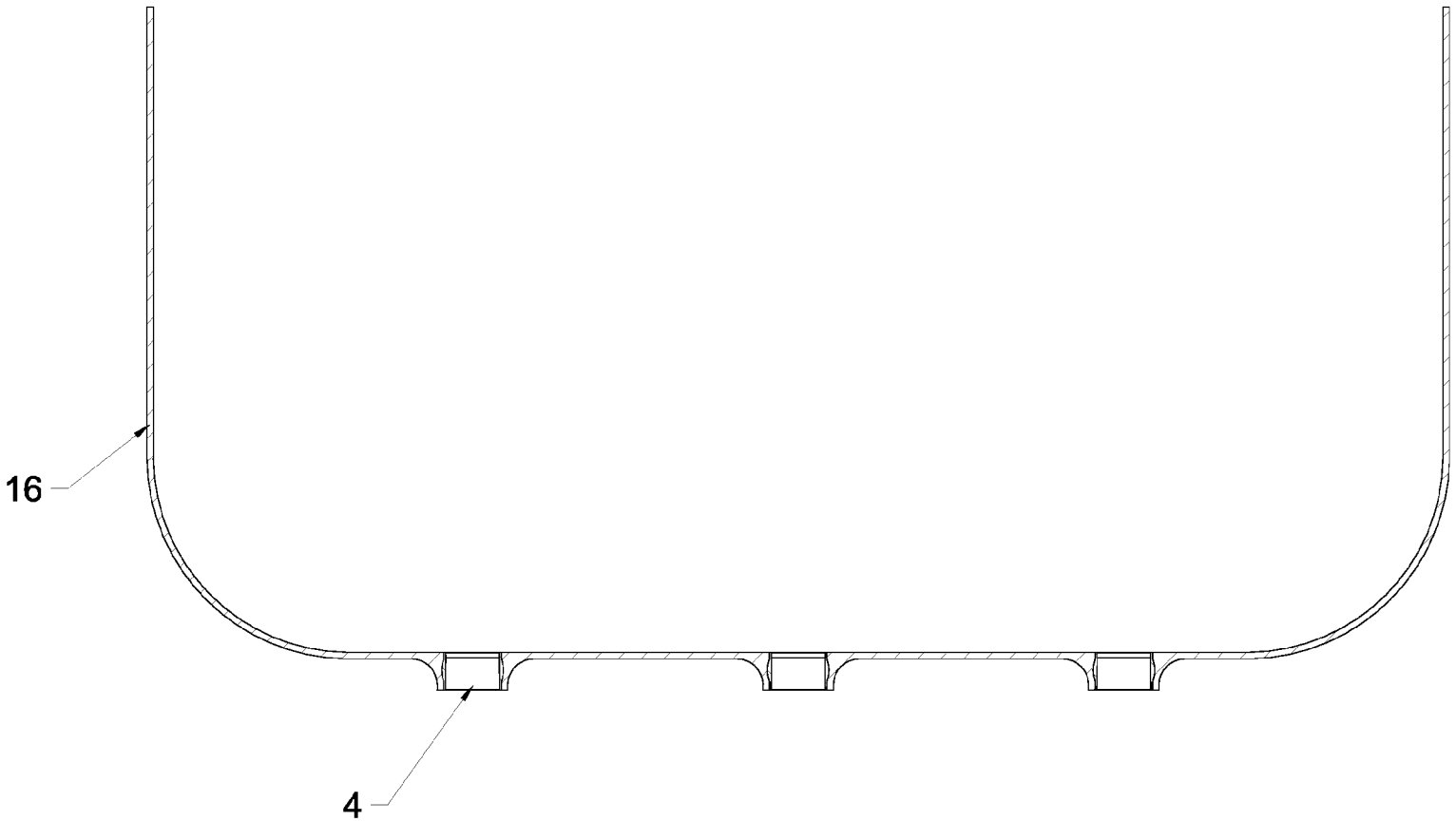
FIG. 1*b* is a cross section of a first implementation of a nozzle mounting assembly with mounting rings molded into a prefabricated swimming pool shell.

FIG. 1*b* illustrates a nozzle mounting assembly implementation incorporating a plurality of mounting rings 4 rather than elbow connectors. The plurality of mounting rings 4 may be placed at predetermined locations along the surface of a prefabricated swimming pool shell 16, and may be molded into the floor, walls, and/or steps of the swimming pool shell 16. Material applicators add fiberglass or other suitable material as known in the applicable art to a swimming pool casting, and form a swimming pool shell 16 around the plurality of mounting rings 4. Mounting rings of varying sizes, shapes and dimensions may be used to match the nozzles used for a particular implementation. As is apparent for comparison with FIG. 1*a*, use of the mounting rings 4, instead of the conventional elbows, significantly increases the ability to stack the pool shells and the number of shells that may be stored and transmitted together.

Figure 2:
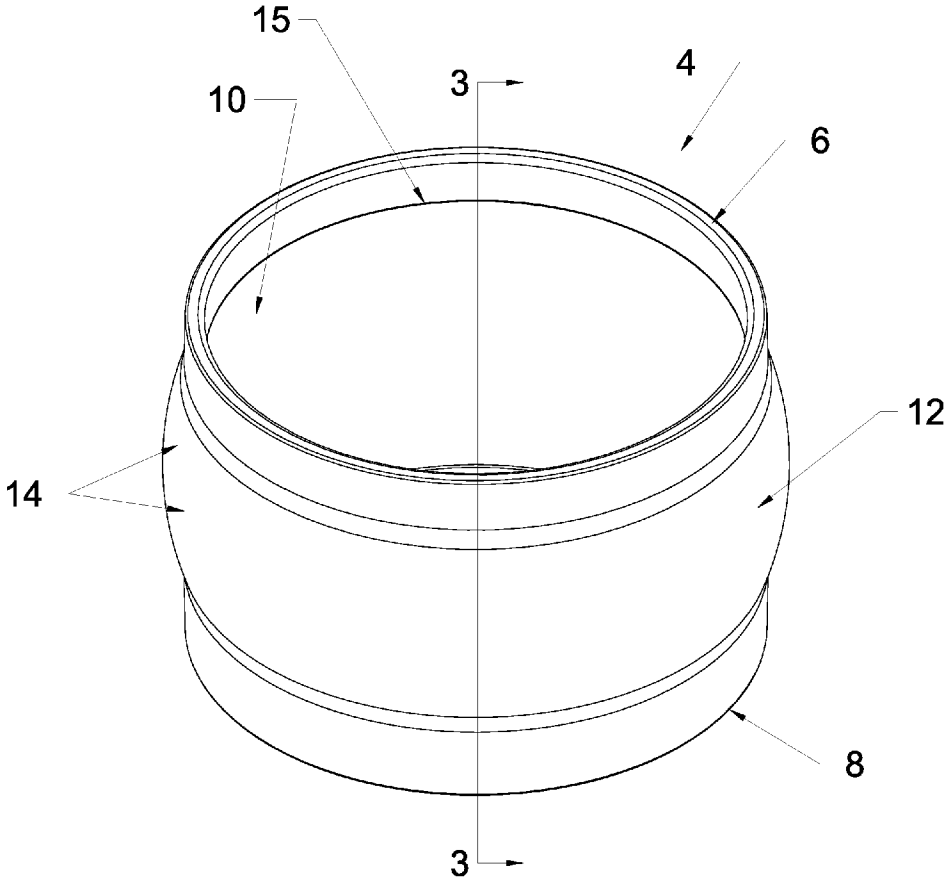
FIG. 2 is a perspective view of a mounting ring.
Figure 3:
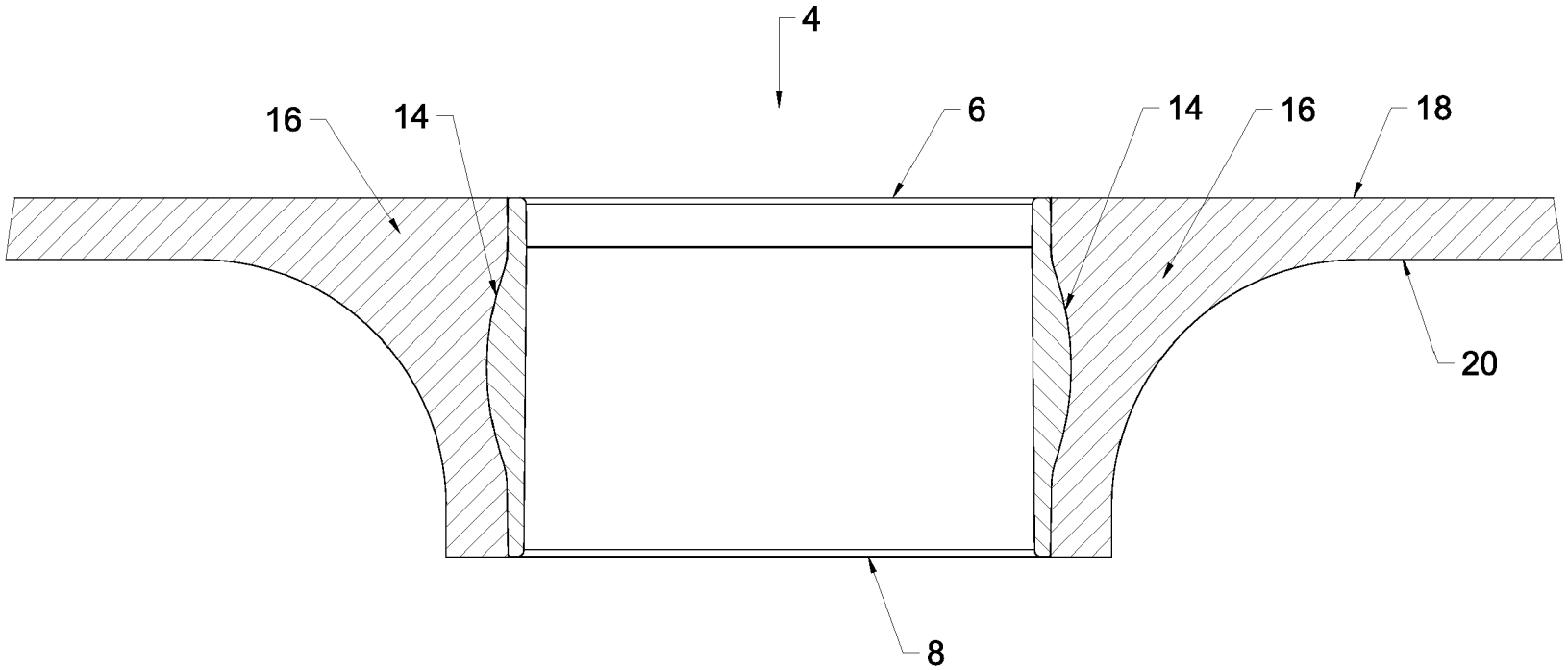
FIG. 3 is a cross-section view of the mounting ring of FIG. 2 installed in a swimming pool shell.
Figure 6:
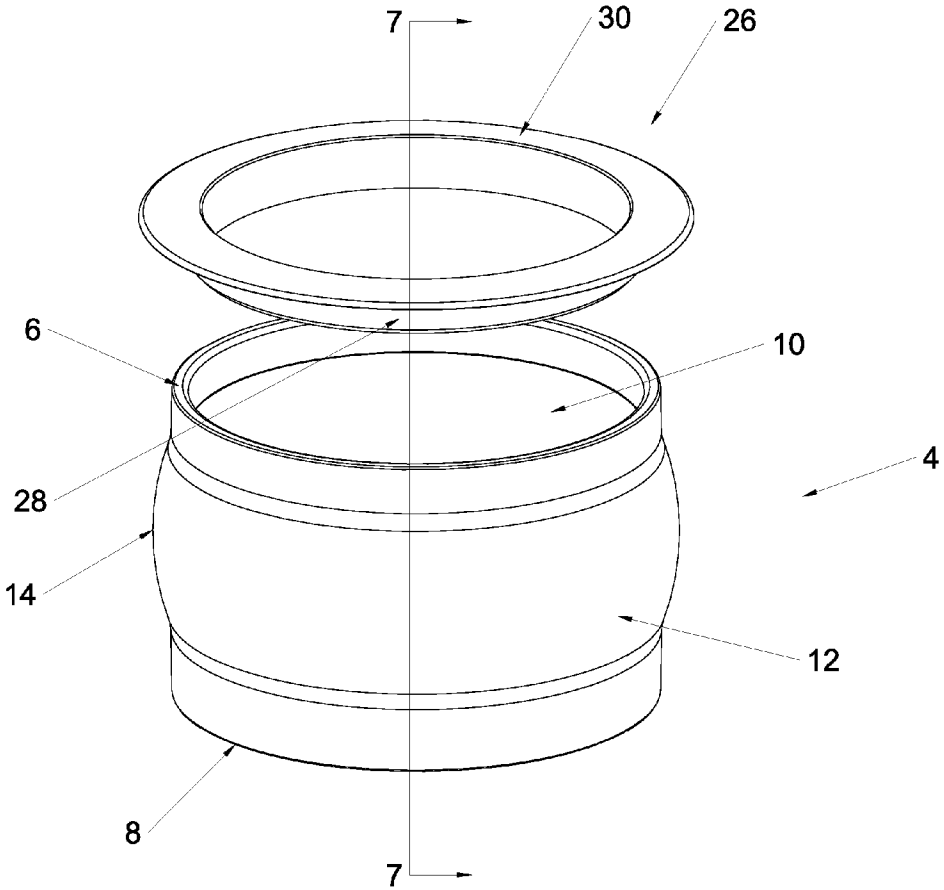
FIG. 6 is a perspective view of a trim ring and mounting ring.

FIG. 2 illustrates a first implementation of a single mounting ring 4. The mounting ring 4 of this particular implementation is generally cylindrical, with at least one protrusion along the outside surface 12 of the mounting ring 4. The inside surface 10 of the mounting ring 4 is substantially cylindrical and has an inside diameter 15. Referring to FIGS. 2, 3 and 6, the at least one protrusion may be a substantially continuous, annular protrusion 14. The annular protrusion 14 may extend from a first end 6 of the mounting ring 4 to a second end 8 of the mounting ring 4, but may be narrower than the distance from the first end 6 to the second end 8 of the mounting ring 4 as shown in FIGS. 2 and 3.

Alternative implementations may include mounting rings where the at least one protrusion along the outside surface of the mounting ring is not a substantially continuous, annular protrusion, but instead extends at one or more, and even periodic locations on the outside surface of the mounting ring. The at least one protrusion may alternately be comprised of a non-continuous outside surface, a rectangular protrusion, a parabolic protrusion, or other shape as known in the art consistent with the stated purpose of a mounting ring as disclosed herein. The outside surface of the mounting ring may be smooth or textured to increase adhesion of the fiberglass resins, increasing the bond strength and reducing the chance of leaks between the mounting ring and the pool shell.

Whatever the dimensions or shape, the one or more protrusions act to displace the water force that acts upon a nozzle mounting assembly after water is added to a swimming pool. The protrusion(s) key into the fiberglass material and add strength to the joint in the horizontal direction where traditional fittings would rely on a side frictional and chemical bond to hold it in place.

Referring to FIG. 3, the first implementation is shown in cross-section view taken along line 3-3 of FIG. 2 and depicts the positioning of one of the plurality of mounting rings 4 within a prefabricated swimming pool shell 16. The mounting ring 4 has a first end 6 that coincides with the inner surface 18 of the swimming pool shell 16. The mounting ring 4 also has a second end 8 that is opposite the first end 6 and extends below the outer surface 20 of a swimming pool shell 16.

Figure 4:
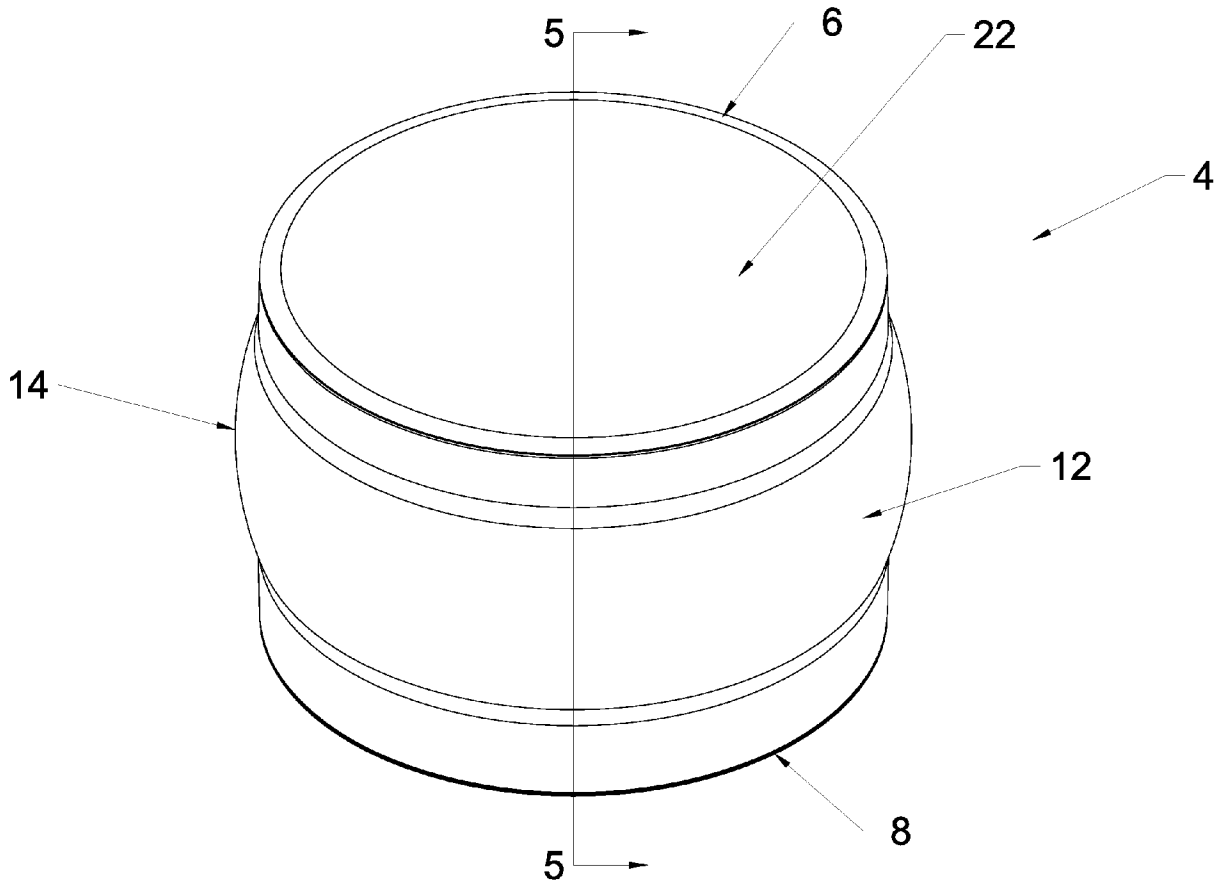
FIG. 4 is a perspective view of a mounting ring showing a first removable construction cap.

FIG. 4 illustrates an implementation that also includes a first removable construction cap 22. In implementations where a first removable construction cap is used, a removable construction cap 22 is placed in each of the plurality of mounting rings 4. The first removable construction caps 22 generally couple with the first ends 6 of the plurality of mounting rings 4 prior to a swimming pool shell being formed around the plurality of mounting rings 4. The plurality of first removable construction caps 22 protect the mounting rings' inside surfaces from the fiberglass and other construction materials used to form the pool shell. Each first removable construction cap 22 includes a lower fitting that slidably couples with the first end 6 of the mounting ring 4, and an upper flange that covers the annular lip of the mounting ring 4.

Figure 5:
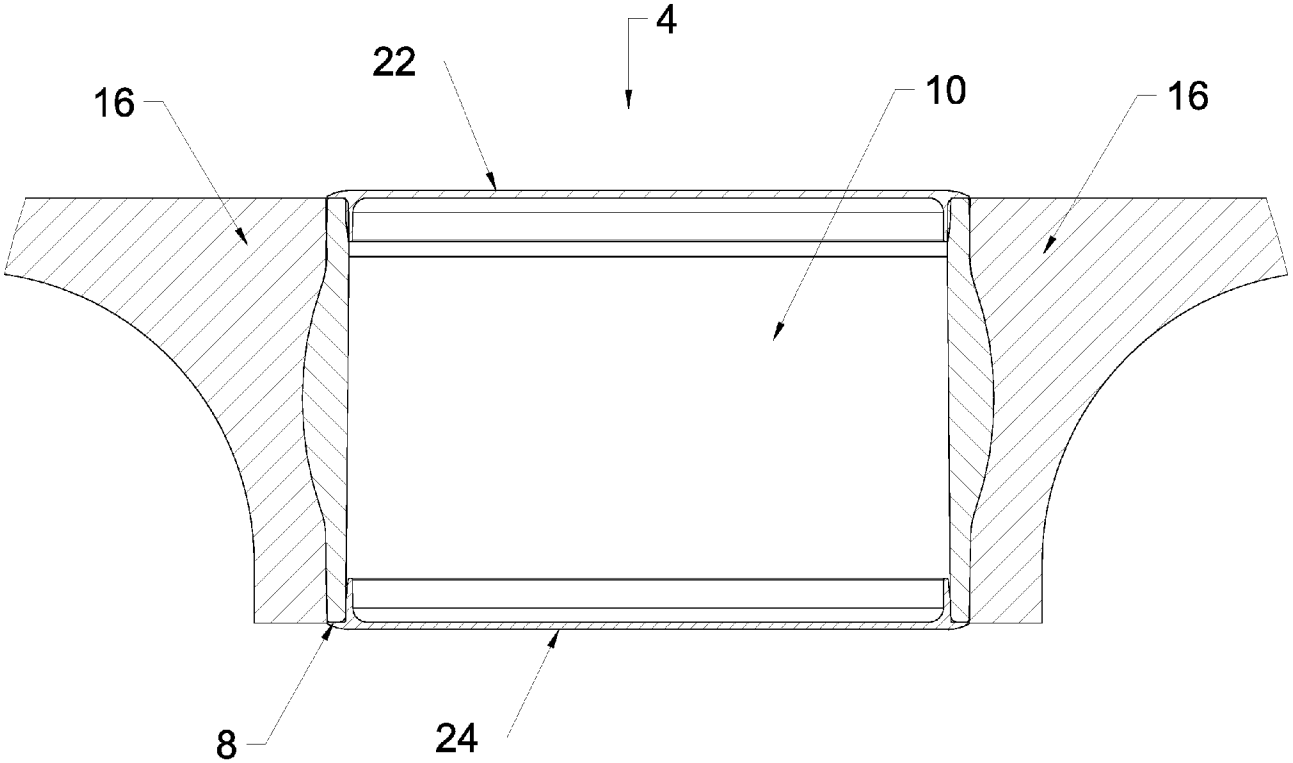
FIG. 5 is a cross-section view of the mounting ring of FIG. 4 installed in a swimming pool shell.

FIG. 5 illustrates an implementation that includes the first removable construction cap 22, but also adds a second removable construction cap 24 to each of the plurality of mounting rings 4. The second removable construction cap 24 is generally coupled with a second end 8 of the mounting ring 4, and protects the mounting ring's inner surface 10 throughout the construction process and during relocation of the swimming pool shell 16. The second removable construction cap 24 would typically be left in place until the swimming pool shell 16 and the plurality of nozzle fittings are ready to be installed. Similar to the first removable construction cap 22, the second removable construction cap 24 includes a lower fitting that slidably couples with the second end of the mounting ring 4, and an upper flange that covers the annular lip of the mounting ring 4. The first and second removable construction caps 22, 24 are not required, but assist in protecting the mounting ring 4 during the fabrication and installation processes.

Figure 7:
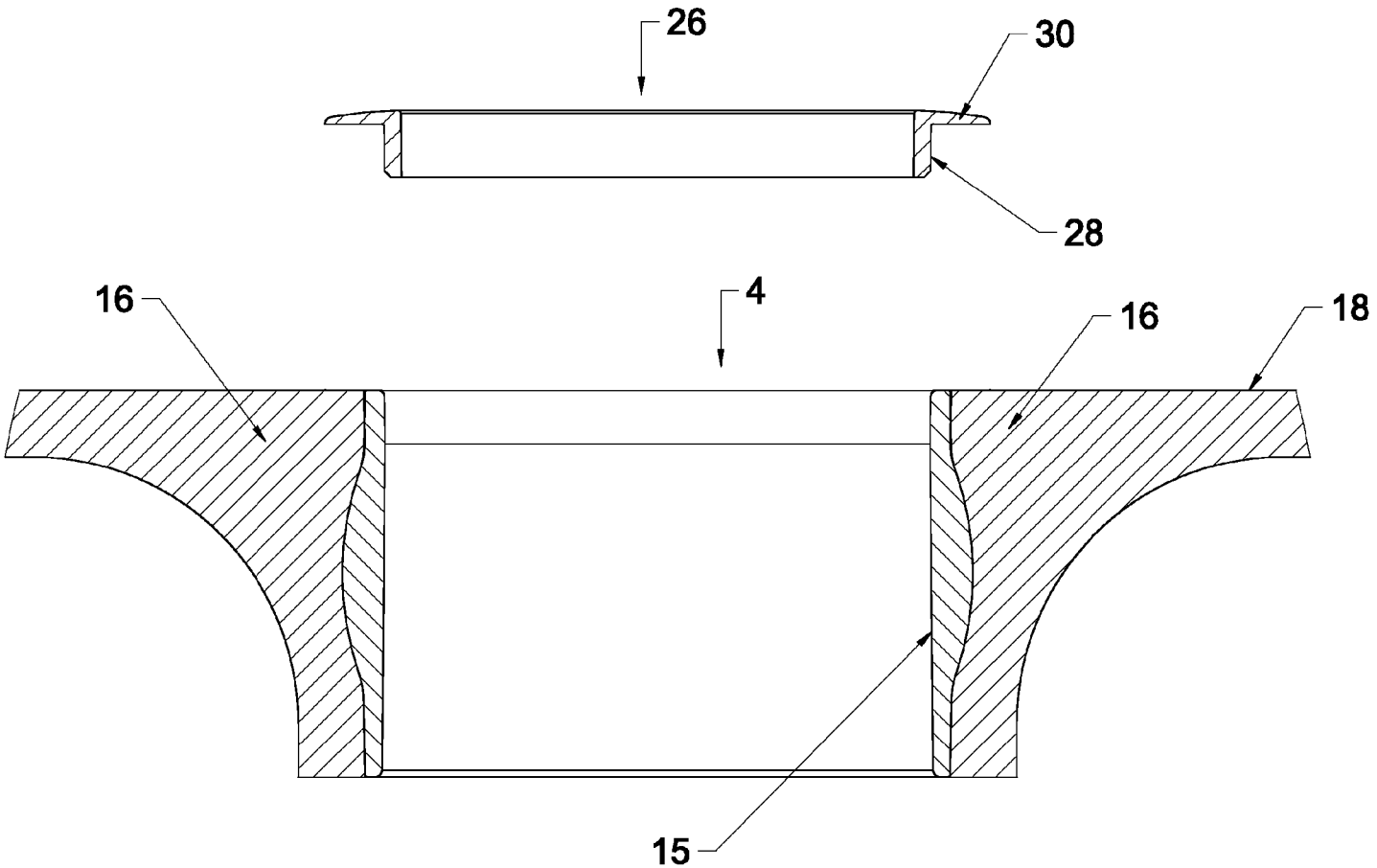
FIG. 7 is a cross-section view of the trim ring and mounting ring of FIG. 6 installed in a swimming pool shell.
Figure 8:
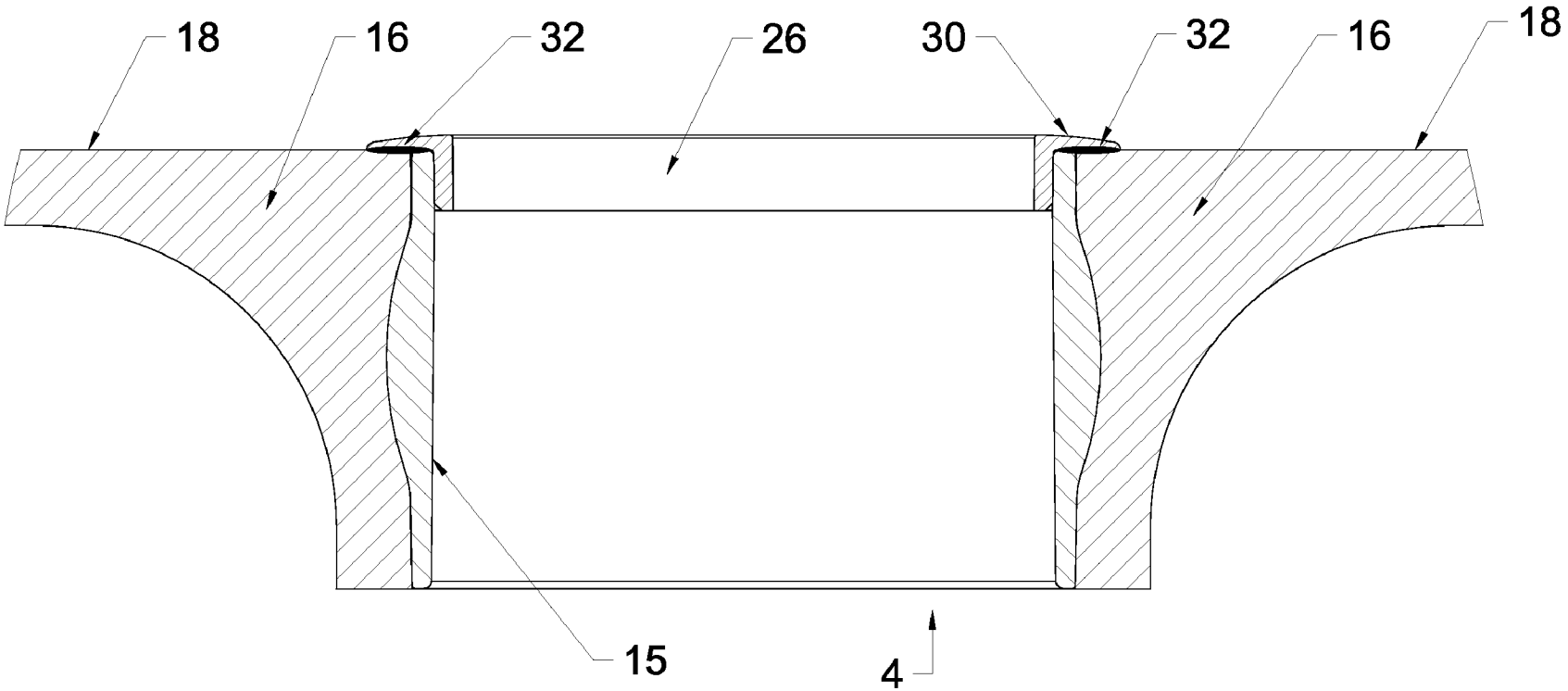
FIG. 8 is a cross-section view with the trim ring coupled to the mounting ring.

In particular implementations, a trim ring 26, such as that shown in FIGS. 6 and 7, may be used. The trim ring 26 of the implementation shown in FIGS. 6 and 7 includes a lower annular fitting 28 that slidably couples with the first end 6 of a corresponding mounting ring 4. The trim ring 26 further includes an upper flange 30 that extends radially outward from the lower fitting 28 and fits substantially parallel to the inner surface 18 of the swimming pool shell 16 as shown in FIG. 8. FIG. 8 further illustrates how the upper flange 30 of a trim ring 26 may be secured to the inner surface 18 of the swimming pool shell 16 using a silicone seal 32 or similar water resistant material, such as another adhesive or gasket.

Figure 9:
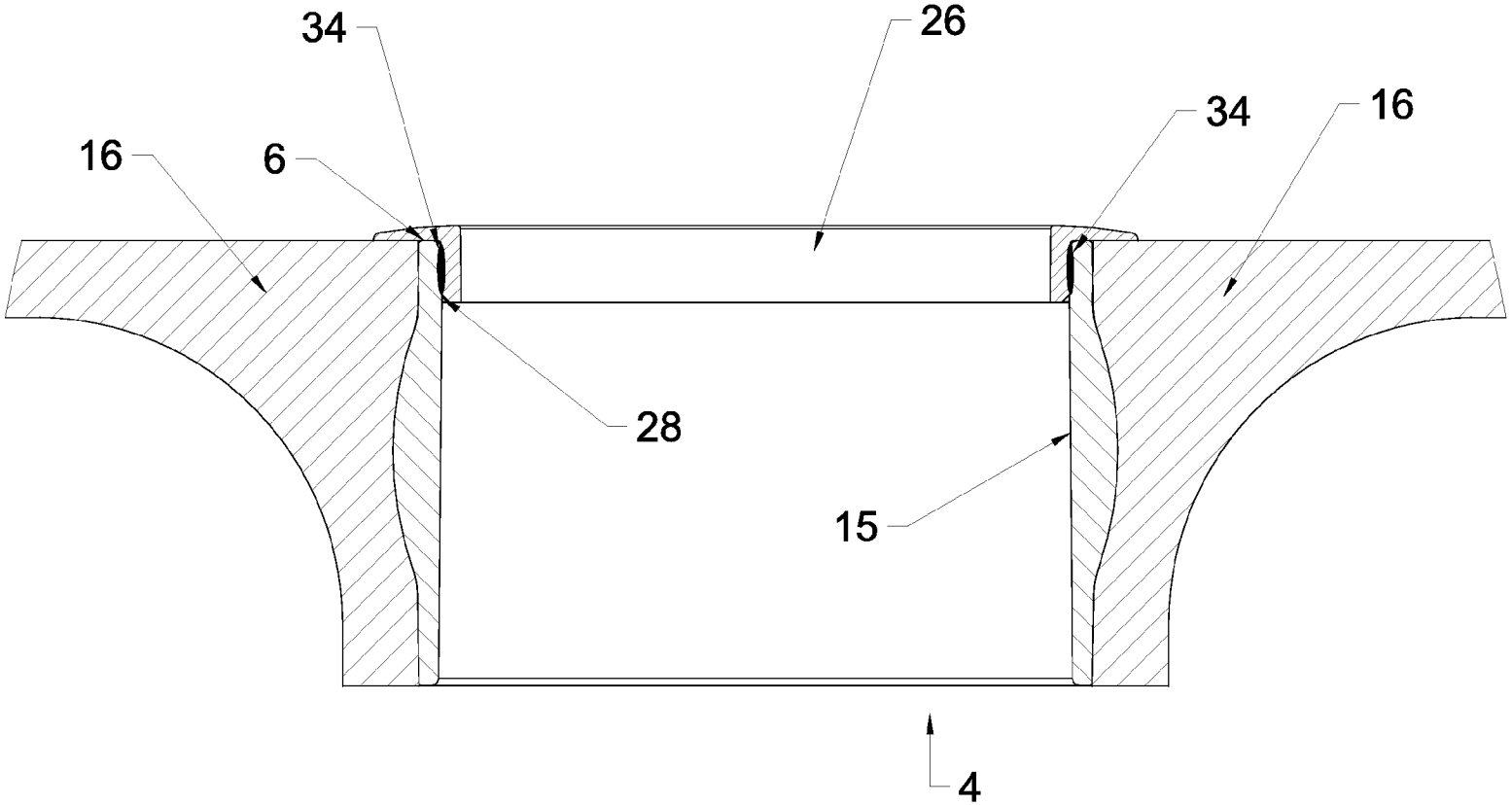
FIG. 9 is a cross-section view of the trim ring and mounting ring of FIG. 8 showing glued surfaces.

FIG. 9 illustrates an implementation where the trim ring 26 is further secured to the corresponding mounting ring 4 using a solvent weld 34. The solvent weld 34 generally covers the outside circumference of the trim ring's lower fitting 28 where the trim ring 26 interfaces with the first end 6 of the mounting ring 4. Other adhesives or methods of coupling the trim ring's lower fitting 28 with the first end 6 of the mounting ring 4 may alternatively be used.

Figure 10:
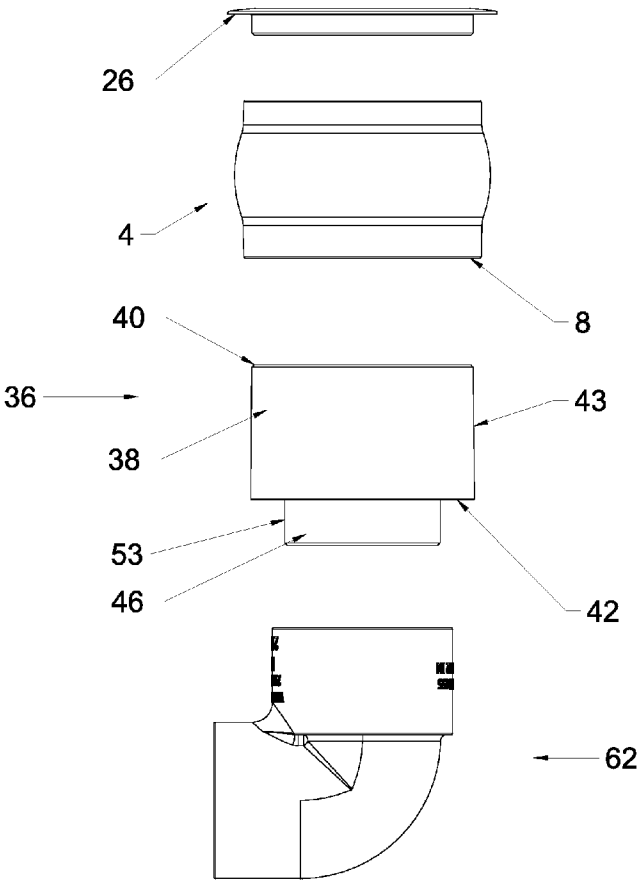
FIG. 10 is a front view of a nozzle mounting assembly connected to an elbow section.
Figure 11:
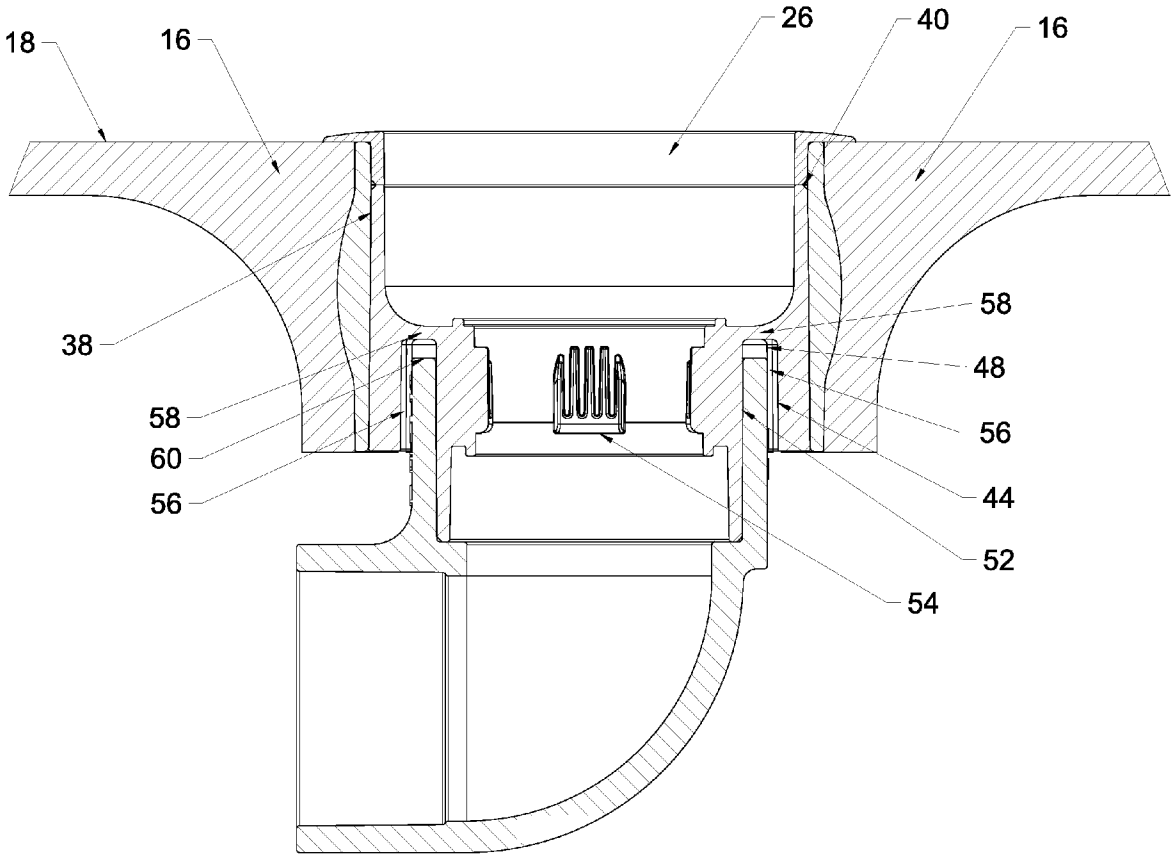
FIG. 11 is a cross-section view of the nozzle mounting assembly of FIG. 10 installed in a swimming pool shell.

Particular implementations may further comprise a nozzle retainer body 36, such as that shown in FIGS. 10 and 11. A plurality of nozzle retainer bodies 36 would be used with the plurality of mounting rings 4. A nozzle retainer body 36 couples with the second end 8 of each corresponding mounting ring 4.

The nozzle retainer body 36 has a first body member 38 and a second body member 46, which may be formed as a single unit or formed separately and subsequently coupled together. The first nozzle retainer body member 38 has a substantially cylindrical outside surface with a first end 40 diameter 43 that is substantially the same size as, or slightly smaller or slightly larger than, an inside diameter 15 of the corresponding mounting ring 4. Other shapes for the inside surface of the mounting ring 4 and outer surface of the first nozzle retainer body member 38, as well as similar components of the second nozzle retainer body member 46 described more below, are contemplated so long as the two are able to mate together, but cylindrical shapes are standard in the plumbing industry. The first end 40 of the first nozzle retainer body member 38 slidably couples with the second end 8 of the corresponding mounting ring 4.

Similarly, the second nozzle retainer body member 46 has a substantially cylindrical outside surface with an outside diameter 53 that is substantially the same size as, or slightly smaller than, or slightly larger than the outside diameter 43 of the first nozzle retainer body member 38. The second nozzle retainer body member 46 is coupled with the first nozzle retainer body member 38 and extends outward from the second end 42 of the first nozzle retainer body member 38. The second nozzle retainer body member 46 is sized to couple with a plumbing fitting 62 as shown in FIG. 10. The plumbing fitting 62 may be an elbow section or other fitting as needed for a particular implementation.

Figure 12:
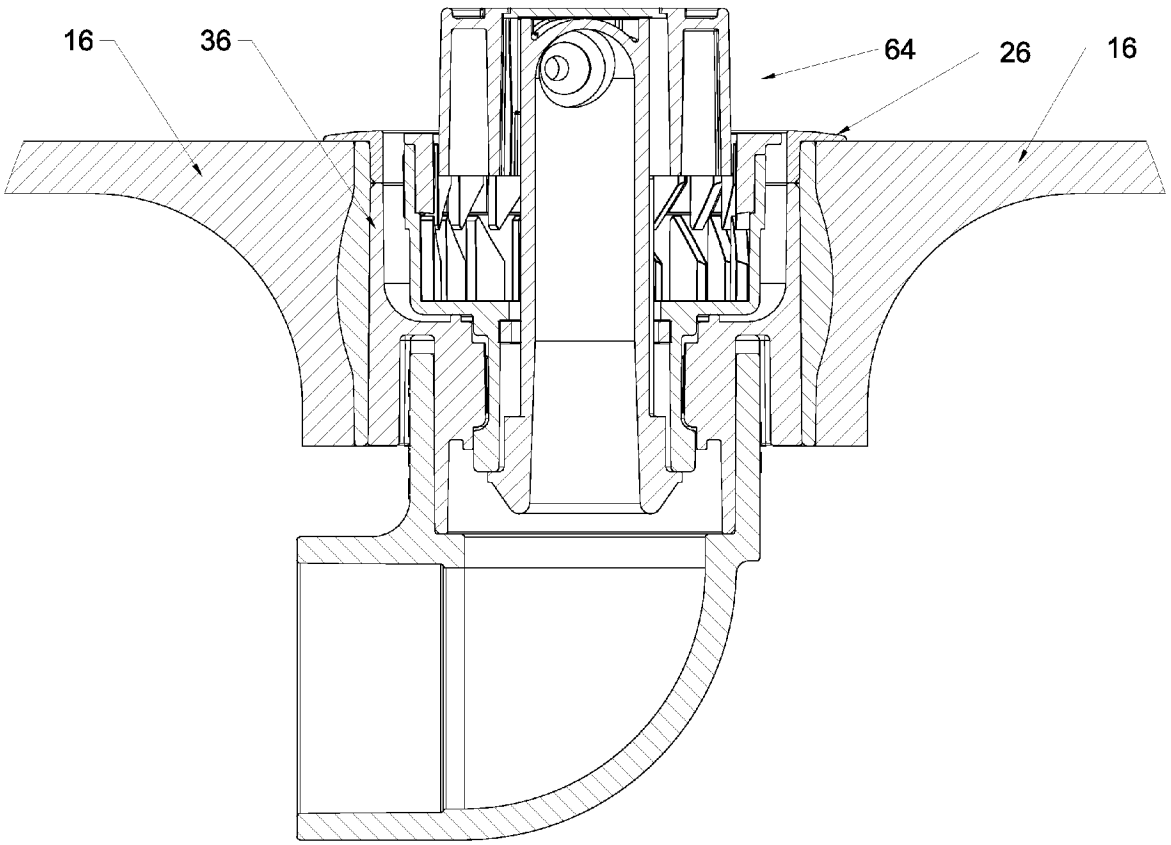
FIG. 12 is an alternative cross-section of the nozzle mounting assembly of FIG. 10 with a cleaning system floor pop-up nozzle.

The second nozzle retainer body member 46 further may include a plurality of nozzle lugs 54 on an inside surface as shown in the cross section of FIG. 11, or another fitting such as a threaded fitting or other conventional connection for parts. The nozzle lugs 54, or other fittings are used to position and secure a cleaning system nozzle mechanism 64 or devices (not shown), such as but not limited to a fountain, a return fitting or an equipment anchor, to the inside surface of the second nozzle retainer body member 46 as shown in FIG. 12. U.S. Pat. Nos. 6,301,723 to Goettl (filed Nov. 17, 2000) and 6,367,098 to Barnes (filed Nov. 17, 2000) show and describe the manufacture and use of nozzle lugs to secure a cleaning nozzle and are hereby incorporated herein by this reference for their relevant disclosures.

Although it is not required for all implementations, the second nozzle retainer body member 46 may be joined to the first nozzle retainer body member 38 by an interfacing section 58 that is oriented generally parallel to the corresponding swimming pool shell inner surface 18. The interfacing section 58 is positioned above the second end 42 of the first nozzle retainer body member 38. For the particular implementation shown in FIG. 11, the area between the lower inside surface 44 of the first nozzle retainer body member 38, the outside surface 52 of the second nozzle retainer body member 46, and the interfacing section 58 forms a recessed channel 56. The depth of the recessed channel 56 is defined by the overlapping distance between the second end 42 of the first nozzle retainer body member 38 and the first end 48 of the second nozzle retainer body member 46. Although this is not required in all implementations, including the recessed channel 56 adds structural strength to the nozzle retainer body 36. A top end of an adjoining plumbing component 60 fits more securely within the recessed channel 56 as compared with existing fitting types common with in-ground swimming pool cleaning systems. The recessed channel 56 better supports the water and foundation forces that act upon the nozzle retainer body 36 by better distributing these forces across the plumbing members. The laminated surfaces between parts 16, 4, 36, and 62 that make up and fill this recessed channel, when bonded together add combined strength to the area of most flexure in the pool shell-to-plumbing connection. In other implementations, no recess channel is used.

FIG. 12 illustrates the implementation of FIG. 11 with a retractable cleaning system nozzle mechanism 64 installed within a nozzle mounting assembly. The cleaning system nozzle mechanism 64 fits inside of the nozzle retainer body 36. The cleaning nozzle mechanism 64 generally travels upward through the trim ring 26 of the mounting ring 4 when water pressure is activated within the plumbing system, while retracting back through the trim ring 26 when the water pressure is deactivated.

Figure 13:
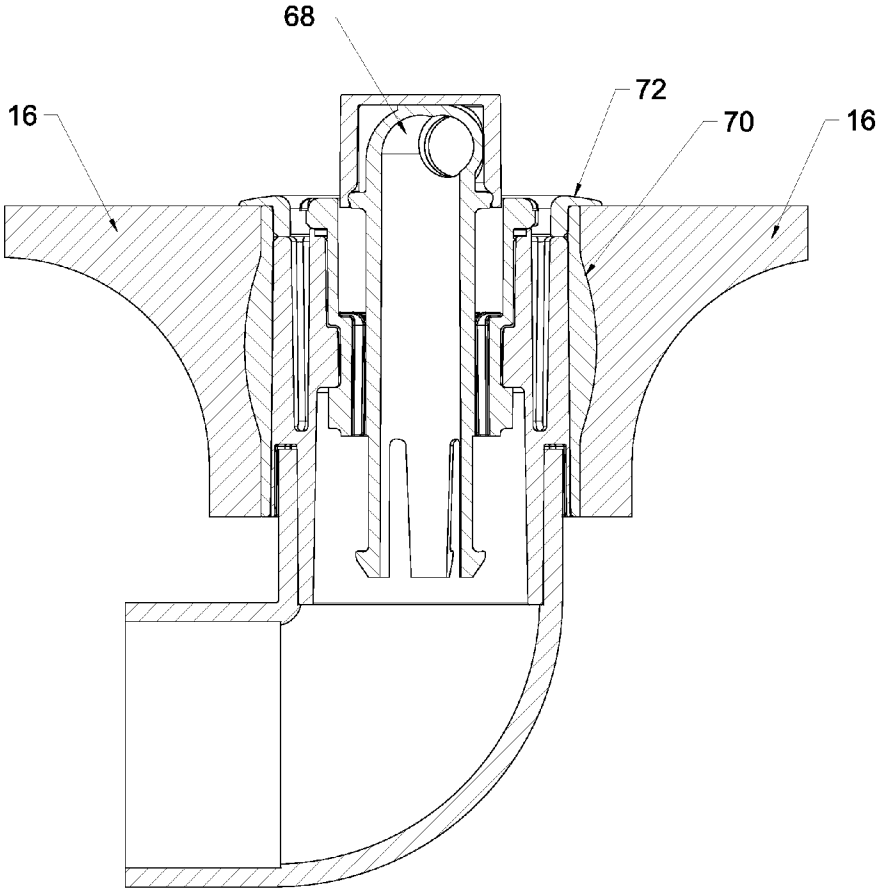
FIG. 13 is an alternative cross-section of the nozzle mounting assembly of FIG. 10 with a cleaning system step pop-up nozzle.

This disclosure, its aspects and implementations, are not limited to the specific components or assembly procedures disclosed herein. Many implementations are possible. For example, other implementations may include nozzle mounting assemblies that are sized for use on swimming pool steps as depicted in FIG. 13. The cleaning nozzle mechanisms designed for swimming pool steps are typically smaller than the nozzle mechanisms incorporated into swimming pool floors. The implementation of FIG. 13 includes a step mounting ring 70 that is smaller than the mounting ring designed for swimming pool floor implementations. The step mounting ring 70 also has a corresponding step trim ring 72. This particular implementation incorporates a step pop-up head 68. Like the first implementation, though, the step mounting ring 70 is molded within the prefabricated swimming pool shell 16. Other particular implementations may include nozzle mounting assemblies that are sized for use along the sides or other positions within a swimming pool.

Figure 14:
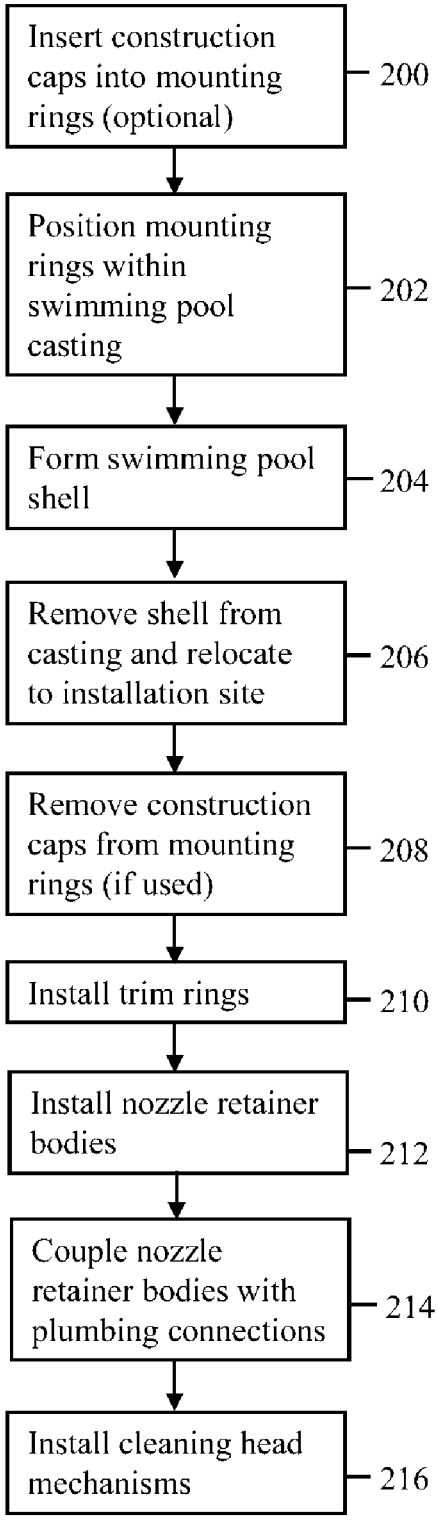
FIG. 14 is a method diagram for installing a nozzle mounting assembly.

FIG. 14 identifies several method steps that may be completed when installing a nozzle mounting assembly. Prior to initiating an installation process, the appropriate sizes and quantities of mounting rings will be selected based upon the corresponding size of a prefabricated swimming pool shell and the number and location of plumbing connections to be used with a particular implementation. Some implementations will use mounting rings for swimming pool bottoms only, while other implementations may use additional mounting rings for swimming pool steps and/or walls. After a plurality of mounting rings is selected, optional first removable construction caps may be secured to a first end of a plurality of mounting rings and optional second removable construction caps may be secured to a second end of the plurality of mounting rings (Step 200). Optionally, zero, one or two removable construction caps may be used. With the optional removable construction caps in place, if used, the plurality of mounting rings is positioned within a swimming pool casting for prefabricated swimming pools (Step 202). The plurality of mounting rings may be positioned according to the desired distribution of cleaning head nozzles, and the first end of the plurality of mounting rings aligns with the surface of the casting that defines the inner surface of a swimming pool shell.

When the plurality of mounting rings is correctly positioned within the casting (step 202), fiberglass or other suitable material as known in the applicable art is sprayed or otherwise applied into the casting and the swimming pool shell is formed (Step 204). The thickness of the swimming pool shell is generally less than the distance from the first end to the second end of the plurality of mounting rings. A sloping envelope of fiberglass is created between the second end of the plurality of mounting rings and the lower surface of the swimming pool shell. The sloping envelope is narrowest adjacent to the second end of the plurality of mounting rings, and increases in diameter as the envelope transitions towards the bottom surface of the swimming pool shell.

In a conventional swimming pool shell manufacturing process, the installer is required to hand-apply a protective layer of fiberglass or other suitable material around a large elbow joint (see FIG. 1*a*) balancing on the pool casting and then manually apply layers of fiberglass around the elbow joint prior to shipment. Using a plurality of mounting rings instead of the conventional elbow joints significantly simplifies installation.

The swimming pool shell then cures within the casting. Once the swimming pool shell has cured, the shell may be removed from the casting and relocated to an installation site (Step 206). The swimming pool shell may be relocated to a warehouse, retail site, or other suitable storage location in transition to the installation site.

If the first and second plurality of removable construction caps were used during the manufacturing process, the caps are then removed from the plurality of mounting rings (Step 208). With the construction caps removed, a plurality of trim rings may be installed (Step 210) by coupling the plurality of trim rings with the corresponding first end of the plurality of mounting rings at the inside surface of the pool shell. The trim rings may be secured to the first end of the plurality of mounting rings using a PVC glue or other adhesive. A silicone sealant may also be applied between the upper flange of the plurality of trim rings and the inner surface of the swimming pool shell. The trim rings create a smooth and finished look for the plurality of nozzle mounting assemblies along the top surface of the swimming pool shell. The trim rings also correct any misalignment that may exist between the first end of the plurality of mounting rings, or the nozzle retainer bodies, and the top surface of the swimming pool shell. The trim rings help to prevent water seepage around the plurality of mounting rings, especially when there is misalignment of some of the plurality of mounting rings.

After the trim rings are installed, a plurality of nozzle retainer bodies, one for each mounting ring, are installed (Step 212) by coupling the plurality of nozzle retainer bodies with the corresponding plurality of mounting rings. The plurality of nozzle retainer bodies couple at a first end with a second end of the plurality of mounting rings. When the nozzle retainer body 36 is inserted into the trim ring 4, the nozzle retainer body 36 may be pressed up flush against the lower annular fitting so that the nozzle retainer body 36 is always aligned with the inner surface of the pool and always at a known distance (set by the height of the lower annular fitting of the trim ring 26). The combination of the mounting ring, the trim ring and the nozzle retainer body significantly simplify the alignment process so that when a nozzle is installed into the nozzle retainer body, the nozzle is properly positioned and aligned in relation to the inner surface of the pool.

The plurality of nozzle retainer bodies can then be coupled to a plurality of plumbing connections (Step 214) at a second end of the plurality of nozzle retainer bodies. The plurality of plumbing connections are typically in place at the swimming pool installation site prior to the pool being placed. The plurality of plumbing connections may be secured to the second end of the plurality of nozzle retainer bodies with PVC glue or other conventional adhesive.

When the components of the nozzle mounting assembly are installed as described, a plurality of cleaning head mechanisms are installed by inserting the plurality of cleaning head mechanisms within the plurality of nozzle retainer bodies (Step 216). The plurality of cleaning head mechanisms may be secured to the plurality of nozzle retainer bodies. Once the plurality of cleaning head mechanisms are installed, the swimming pool is ready to be filled with water and the underground plumbing system can be activated. The plurality of cleaning head mechanisms will engage whenever pressurized water is activated through the plumbing system.

It will be understood that many modifications of structure, arrangement, proportions, materials, and components may be used, which are adapted to specific environments and operative requirements. Accordingly, nozzle mounting assemblies are not limited to the specific components disclosed herein, as virtually any components consistent with the intended operation of a nozzle mounting assembly implementation may be utilized. For example, although particular components for nozzle mounting assembly implementations are disclosed, such components may comprise any shape, size, style, type, model, version, measurement, concentration, material, quantity, and/or the like consistent with the intended operation of a nozzle mounting assembly implementation. Additionally, implementations are not limited to the use of any specific components, provided that the components selected are consistent with the intended operation of a nozzle mounting assembly implementation.

Furthermore, the components defining any particular nozzle mounting assembly implementation may be formed of any of many different types of materials or combinations thereof that can readily be formed into shaped objects, provided that the components selected are consistent with the intended operation of a nozzle mounting assembly implementation. For example, the components may be formed of plastics, thermoplastics, such as fluoropolymers, polycetal, polycarbonate, polyethane, and the like, thermosets, such as polyimide, polyurethane, and the like, plastic resins and/or other like materials commonly found in the industry. Those of ordinary skill in the art will readily be able to select appropriate materials and manufacture these products from the disclosures provided herein.

Some of the components defining a particular nozzle mounting assembly implementation may be manufactured simultaneously and integrally joined with one another, while other components may be purchased pre-manufactured or manufactured separately and then assembled with the integral components. The various implementations may be manufactured using conventional procedures as added to and improved upon through the procedures described herein.

Accordingly, manufacture of these components separately or simultaneously may involve extrusion, vacuum forming, injection molding, blow molding, casting, pressing, bending, hardening, cutting, and/or the like. Components manufactured separately may then be coupled or removably coupled with the other integral components in any manner, such as with adhesive, a silicone bond, a waterproof fastener, wrapping, any combination thereof, and/or the like. Coupling techniques may depend upon, among other considerations, the particular material forming the components.

In places where the description above refers to particular implementations of a nozzle mounting assembly, it should be readily apparent that a number of modifications may be made without departing from the spirit thereof and that these implementations may be applied to other nozzle mounting assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A method of installing a nozzle mounting assembly for an in-floor swimming pool cleaning system, the method comprising:

positioning a plurality of mounting rings within a swimming pool casting;

forming a swimming pool shell on the swimming pool casting;

removing the swimming pool shell from the swimming pool casting and relocating the swimming pool shell to a swimming pool installation site;

installing a trim ring in a first end of each mounting ring and abutting the trim ring against an inner surface of the swimming pool shell;

installing a nozzle retainer body in a second end of each mounting ring and abutting the nozzle retainer body against the trim ring to align it with the inner surface of the swimming pool shell; and installing a plurality of cleaning head mechanisms in the plurality of nozzle retainer bodies, one cleaning head mechanism in each nozzle retainer body.

2. The method of claim 1, further comprising:

inserting a plurality of first removable construction caps into a first end of one of the plurality of mounting rings prior to forming the swimming pool shell; and removing the plurality of first removable construction caps from the plurality of mounting rings after forming the swimming pool shell.

3. The method of claim 1, further comprising:

inserting a plurality of second removable construction caps into a second end of one of the plurality of mounting rings prior to forming the swimming pool shell; and removing the plurality of second removable construction caps from the plurality of mounting rings after forming the swimming pool shell.

4. The method of claim 1, further comprising forming a waterproof seal associated with each trim ring.

5. The method of claim 4, wherein forming a waterproof seal comprises applying a silicon seal between each trim ring and the inner surface of the swimming pool shell.

6. A method of forming a swimming pool shell, the method comprising:

positioning a plurality of mounting rings within a swimming pool casting at preselected locations corresponding to intended locations for a plurality of swimming pool cleaning head nozzles, each of the plurality of mounting rings comprising a substantially cylindrical surface comprising at least one protrusion, and open first and second ends;

forming a swimming pool shell around the plurality of mounting rings such that the at least one protrusion is at least partially enclosed by the swimming pool shell;

allowing the swimming pool shell to cure; and removing the swimming pool shell from the swimming pool casting.

7. The method of claim 6, further comprising:

inserting a plurality of first removable construction caps into a first end of one of the plurality of mounting rings prior to forming the swimming pool shell.

8. The method of claim 6, further comprising:

inserting a plurality of second removable construction caps into a second end of one of the plurality of mounting rings prior to forming the swimming pool shell.

9. The method of claim 6, wherein forming the swimming pool shell comprises forming a layer of fiberglass material on the swimming pool casting and around an outer surface of each of the plurality of mounting rings.

10. The method of claim 6, further comprising mounting a trim ring to an inner surface of the swimming pool shell in a first end of each of the plurality of mounting rings such that a waterproof seal is formed.

11. The method of claim 10, further comprising aligning a plurality of nozzle retainer bodies with the inner surface of the swimming pool shell by mounting each nozzle retainer body in a second end of a mounting ring and abutting the nozzle retainer body against the trim ring.

* * * * *